US005934809A

United States Patent [19]

Marbler

[11] Patent Number: 5,934,809

[45] Date of Patent: Aug. 10, 1999

[54] POUCH OF FLEXIBLE PACKAGING MATERIAL WITH INTEGRATED WEAKNESS FOR OPENING

[75] Inventor: Claude A. Marbler, Phalsbourg, France

[73] Assignee: Alusuisse Technology & Management Ltd., Switzerland

[21] Appl. No.: 08/855,408

[22] Filed: May 13, 1997

[30] Foreign Application Priority Data

May 15, 1996 [EP] European Pat. Off. ..... 96810308

[51] Int. Cl.[6] ..... B65D 65/26

[52] U.S. Cl. ..... 383/208; 229/87.05; 383/116; 383/207; 383/109; 383/200

[58] Field of Search ..... 383/208, 200, 383/207, 109, 116, 201; 299/87.05

[56] References Cited

U.S. PATENT DOCUMENTS

| | | | |
|---|---|---|---|
| 1,578,066 | 3/1926 | Bolingbroke . | |
| 2,499,528 | 3/1950 | Reitzes | 383/208 |
| 3,254,828 | 6/1966 | Lerner | 383/207 X |
| 3,278,013 | 10/1966 | Banks | 229/87.05 X |
| 3,451,539 | 6/1969 | Wysocki | 229/87.05 X |
| 3,535,409 | 10/1970 | Rohde | 383/207 X |
| 3,687,358 | 8/1972 | Wink et al. | 383/208 |
| 4,284,194 | 8/1981 | Flatau | 229/87.05 X |
| 4,290,526 | 9/1981 | Haiss | 229/87.05 X |
| 4,658,963 | 4/1987 | Jud | 229/87.05 |
| 5,063,639 | 11/1991 | Boeckmann et al. | 383/208 X |
| 5,316,209 | 5/1994 | Tomisawa et al. . | |
| 5,437,881 | 8/1995 | Jeannin | 383/200 X |
| 5,613,779 | 3/1997 | Niwa | 383/201 |

FOREIGN PATENT DOCUMENTS

| | | | |
|---|---|---|---|
| 2121757 | 1/1994 | United Kingdom | 229/87.05 |

*Primary Examiner*—Jes F. Pascua
*Assistant Examiner*—Robin A. Hylton
*Attorney, Agent, or Firm*—Bachman & LaPointe, P.C.

[57] ABSTRACT

Pouches of flexible packaging material exhibit a tearing zone in the form of a weakness such as perforations or a separation in the material, this in order to be able to remove the contents easily. The packaging material is covered over by at least one film-forming mass, at least in the region of weakness, in order that the package remains closed until the contents are to be used. The film-forming mass may be the decorative printing on the pouch. After packaging, the contents are protected by the pouch and, in order to remove the contents, the pouch may be opened readily by a pulling or snapping movement which causes the covering of film-forming mass to break.

18 Claims, 2 Drawing Sheets

POUCH OF FLEXIBLE PACKAGING MATERIAL WITH INTEGRATED WEAKNESS FOR OPENING

BACKGROUND OF THE INVENTION

The present invention relates to a pouch, coated with a film-forming mass, made of flexible packaging material and featuring a zone for tearing the pouch open.

Filling pouches such as tube-shaped pouches with foodstuffs and closing off the pouch by sealing is known. The contents may be removed for example by tearing the pouch open. Depending on the type of packaging material used, it may be difficult to tear open the pouch. Especially pouches made from flexible packaging materials employing highly elastic or tough plastics are difficult to tear open to remove the contents. For that reason an aid to tearing the plastic is often stamped onto a sealed seam on the package. This enables the pouch to be opened; often, however, the contents of the pouch cannot be removed without spillage e.g., or the pouch must be torn beyond the region offering assistance to tearing it open; very often this is problematic for the user. It has also already been proposed for example to provide the pouches with a tear-open strip. This tear-open strip may extend right round the pouch so that the packaging material separates leaving the pouch open. This is, however, a very complicated process as the tear-open strip has to be incorporated in the packaging laminate material.

The object of the present invention is to provide a pouch which contains an aid to tearing it open which may be placed at any desired place, advantageously at an edge region, and enables the pouch to be opened easily and makes the contents of the pouch accessible in such a manner that the contents may be removed without requiring any additional further manipulation to open the pouch.

SUMMARY OF THE INVENTION

That objective is achieved by way of the invention in that the zone for tearing the pouch open is a weakness in the packaging material and the region exhibiting the weakness is covered over with at least one film-forming mass and, after the packaging step, the contents of the pouch are protected by the pouch and, to remove the contents from the pouch, a pulling or snapping movement breaks the cover layer of film-forming mass, whereupon the contents of the pouch become accessible.

BRIEF DESCRIPTION OF THE DRAWINGS

FIG. 1 shows schematically the production of a tube-shaped pouch;

FIG. 2 shows schematically a view of a tube-shaped pouch;

FIGS. 3, 4 and 5 show the front and rear of a further tube-shaped pouch and the same in the torn open state; and FIG. 6 shows a section through the packaging material in the region of a weakness therein.

DETAILED DESCRIPTION OF PREFERRED EMBODIMENTS

Figure 1:
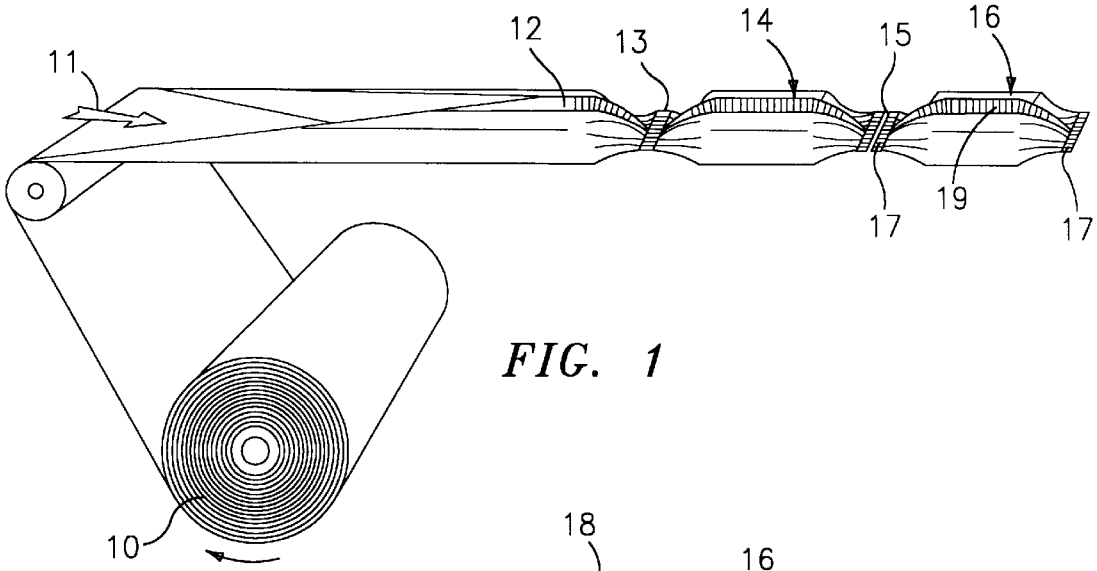
FIGS. 1 to 6 illustrate the present invention further by way of example.

In the present invention pouches are to be understood as for example flat pouches, edge-sealed pouches, pouches having volume or tube-shaped pouches. Preferred are edge-sealed pouches and tube-shaped pouches.

Essentially all known flexible packaging materials may be employed for flexible packaging material, packaging materials, packaging means, packaging films etc. The packaging materials should be useable on machines i.e. suitable for use on packaging machines. Packaging materials include those made from paper, if desired with barrier layers and/or clad with plastics or made from cellulose as cellophane, or packaging materials containing aluminum foils, such as aluminum foils having sealing layers and, if desired, further plastic layers or packaging materials made from plastic films or plastic films that are clad on one or both sides with paper or metal foils, or packaging materials made from plastics having a barrier layer such as a plastic barrier layer, ceramic barrier layer or a metallic barrier layer.

Plastics that may be used may be for example polyolefins, such as polyethylene or polypropylene, polyamide, polyvinylchloride or polyester etc., in each case as a monofilm or as a laminate or in the form of multilayer plastic laminates employing different plastics. Between at least two layers there may be barrier layers such as ethylvinyl-alcohol barrier layers, or ceramic or glass-like or metallic barrier layers. The plastic films or film laminates may have a thickness for example of 10 to 100 $\mu$m, preferably 30 to 50 $\mu$m.

The packaging material may be one sided or double sided, advantageously with a sealing layer on the side to become the side facing the inside of the pouch, said sealing layer being for example an organic sealing layer or sealing film for example of polyolefins such as polyethylenes. For example, for impermeable hot sealed pouches a sealing layer containing 6 to 7 g/m$^2$ sealing lacquer or varnish is adequate.

The packaging material is advantageously in the form of endless strip or in roll form.

The packaging material is provided with a weakness in the region intended for the tear-off zone on the pouch. The weakening of the packaging material may be made by mechanical means for example using a cutting blade, chemically for example using solvents, thermally for example using laser beams, in the form of separation, perforation, notching etc. Preferred is separation. The weakening may be in a straight line or curved and may be such that in the packaging made from the packaging material it extends around the whole periphery or parts of the periphery of the pouch.

The region of weakening on the pouch according to the invention is covered with a film-forming mass. By the region of weakening is meant not only the weakening itself, but also the neighboring parts of the packaging material, for example a region of 2 to 20 mm, advantageously 5 to 10 mm neighboring the weakening.

The pouch according to the invention may be coated with the film-forming mass only in the region of weakness; advantageous, however, is such a pouch which is completely coated with the film-forming mass. The film-forming mass is in particular in the form of the printing on the pouch.

In an advantageous form the film-forming mass in the region of the weakness is thicker than in the rest of the pouch. The film-forming mass may be one layer or a plurality of layers for example two, three, four, five, six etc., layers of film-forming masses. The film-forming mass covers over and closes off the previously made weakness and provides the packaging material again with tensile strength in the region of the weakness.

The film-forming mass or, if employing a plurality of superimposed layers of film-forming masses, the total amount thereof, may in the region of the weakness, advantageously amount to 2 to 8 g/m$^2$, usefully 3 to 6 g/m$^2$ and advantageously 3.5 to 5 g/m$^2$-Outside of the region of weakness the film forming mass may be present in amount e.g. of 1 to 7 g/m$^2$, usefully 1 to 5 g/m$^2$ and advantageously 1 to 4 g/m$^2$.

A film-forming mass may be produced using for example coatings, lacquers, varnishes, printing-inks and printing-colors containing volatile substances such as solvents and non-volatile substances such as film binders, resins, softeners, additives, colorants, pigments, fillers etc. Preferred film-forming masses are lacquers, varnishes, printing-inks or printing-colors containing colorants or pigments, solvents, fillers, further additives and binders. Advantageous binders are resins, varnishes, nitrocellulose, polyamides, vinyl-resins, colophony-resins, maleinic acid-resins, shellac etc. The lacquers are in particular printing-ink or printing-color materials and may be printed onto the previously weakened flexible pouch using a printing machine. The material applied during printing is not only the film-forming mass but at the same time also the decorative, in some cases also informative, printing applied to the pouch. The printing on the packaging material may be applied on the side of the pouch facing outwards or on the side facing inwards, or on both sides.

Substances in a plastic state may be applied as film-forming material for example deposited as a film in a softened or molten state onto the packaging material, onto the side that will face inwards or outwards on the pouch or on both sides.

The film-forming mass may be deposited by extrusion coating. Suitable for extrusion coating are for example polyolefins such as polyethylenes or polypropylenes or materials containing polyvinyl chloride.

Film-forming masses also include coatings of hot-melt masses. These are for example at normal temperatures solid, viscoelastic or viscoplastic materials, preferably on the basis of resins, waxes, thermoplastics and elastomers, if desired with additions of fillers, anti-oxidants, lubricants and the like which, when warmed on passing through a thermoplastic range, change over to become highly fluid melts.

Forming the film on the packaging material using film-forming masses may also take place using chemically drying coatings. The chemical drying coatings contain cross-linked macromolecules which are obtained by chemical reactions, in particular by polymerization.

The film-forming masses may also be films, in particular low tear strength films or highly brittle films. The thickness of the films may be for example from 5 to 20 $\mu$m. Preferred films may contain polyolefins such as polyethylenes or polypropylenes, polyesters or polyamides. The films may be applied to the sides of the packaging material that becomes the inward facing or the outward facing side of the pouch or on both sides thereof; the adhesion of the film or films on the packaging material may be effected by laminate adhesives and/or bonding agents, if desired by additional corona, flame plasma or ozone treatment. For example, the film may exhibit sealing layers, in particular when used on the side of the pouch facing inwards. The film also then represents a sealing layer. The film may also be applied as a further film-forming mass over the print-coating on the packaging material.

If film-forming masses are applied to both the inward facing and the outward facing sides of the packaging material, then these may be the same or different.

The materials of the film-forming masses are usefully of no physiological consequence when used on packaging materials for foodstuffs.

Further examples of film-forming masses on packaging materials are sealing layers or sealing films, e.g. of polyolefins such as polyethylenes, which are deposited on the printing.

The film-forming mass is preferably situated on the side of the pouch facing outwards. The film-forming mass may also be deposited on the side of the pouch facing inwards. It may also represent e.g. the printing-ink or printing-color of an image printed in reverse. A further film-forming mass in the form of a sealing layer may be applied to the printing-ink or printing-color creating the reverse image. The packaging material may also contain a layer of film-forming mass for example a printing-ink or a printing-color on the side of the pouch facing outwards, and a sealing layer on the side of the pouch facing inwards.

The present invention also relates to a process for creating a pouch according to the present invention. The process may be carried out advantageously in such a manner that a weakness is provided in the flexible packaging material and the weakness is subsequently covered over by at least one film-forming mass.

As film-forming mass one may employ for example the above mentioned lacquers, varnishes, printing-inks, printing-colors, extrusion layers, hot-melt masses etc. The deposition of the film-forming masses may be performed for example by centrifuging, slinging, flooding, casting, rolling, spraying, brushing, printing, extruding etc. As a rule, in the case of flexible packaging materials, the process concerns endless strip material, for which reason coating methods such as application extrusion, spraying, rolling, printing or casting are particularly suitable.

In a particularly preferred process the packaging material is provided with a weakness in a printing plant and the printing subsequently carried out using a printing-ink or printing-color as film-forming mass. In this process the flexible packaging material is introduced into a printing machine for example a relief printing machine, intaglio printing machine, offset printing equipment, in particular a flexo-printing machine. Examples of printing machines are auxiliary printing machines, multi-drum; single drum, in-line, flexo and vario printing machines or combinations thereof such as for example flexo and intaglio printing machines. Usefully, the weakness is provided in the flexible packaging material using a cutting blade in the region of the printing facility, prior to the start of printing, or in the case of multi-drum machines in the region of the first drum. Following that, the flexible packaging material has the printing applied to it, in the course of which the weakness in the material is covered over and the film forming mass, i.e. the printing-ink closes off the weakness. The film forming mass is applied in such a manner for example that in the region of the weakness the overall thickness of film forming mass is thicker than on the rest of the packaging material. By means of register control it is possible to regulate the printing process exactly and, apart from achieving a clear printed image, the film forming mass can be applied exactly to the weakness and the region around it.

The pouches obtained from the packaging material may be employed for holding foodstuffs in powder to solid form. A preferred application is the packaging of bars of chocolate, starch-containing foodstuffs, foodstuffs containing fats, or foodstuff preparations in the form of mixtures of chocolate with foodstuffs containing starch and/or fats, all foodstuff preparations advantageously being in the form of bars.

The packaging of bars of chocolate and the like is preferred because, on tearing open the packaging, in this case the chocolate bar serves as the means for snapping the pouch open. If the pouch is made from tube-shaped material, the pouches exhibit transverse sealed seams at the ends or, if the pouch is made from flat material, the pouches exhibit a longitudinal sealed seam and at the ends a transverse sealed seam. The sealing of the seams may be performed by cold sealing, hot sealing or by adhesive bonding.

When packaging for example chocolate bars, the weakness is advantageously situated in one of the end regions of the pouch i.e. about 10 to 30 mm from the end of the pouch which is sealed off by means of a transverse seam. Especially preferred are tube-shaped pouches having a longitudinal sealed seam and transverse sealed seams at the ends. If the pouch is torn open along the weakness, then the tear propagates at maximum around the whole circumference of the pouch; the longitudinal seam prevents the tear propagating any further. The part of the pouch torn open remains attached at the longitudinal seam and the sealing thereof. The contents of the pouch can now be pushed out easily or eaten directly from the packaging; the piece of the pouch that has been torn open remains attached to the rest of the pouch at the longitudinal seam and can not form an individual part be disposed of separately and does not fall to the ground as litter.

As shown in FIG. 1, the packaging material 10, which has already been provided with the weakening and for example a cover layer over the weakening in the form of multicolored printing, is rolled from a stock roll and transported to the packaging stage. The arrow 11 indicates the insertion of the contents which is accompanied continuously by the longitudinal sealing 12 and the transverse seaming 13, as a result of which a packaging unit 14 is created. A cutting device 15 divides the material into tube-shaped pouches 16 with transverse seams 17 and the longitudinal seam 19.

Figure 2:
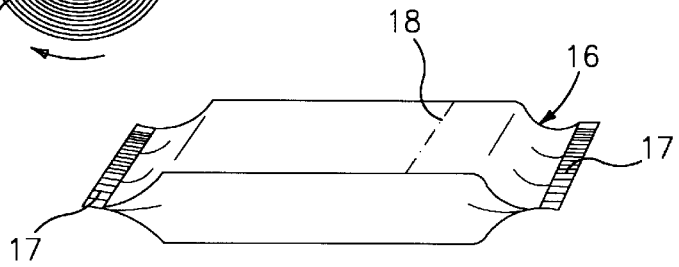

FIG. 2 shows the tube-shaped pouch 16. The longitudinal seam 19 is on the rear side and the pouch 16 is closed at both ends by transverse seams 17. Shown by a broken line is the weakness 18 which is situated in the region of one end of the pouch 16 and is covered over for example by one or more layers of a printing-ink.

Figure 3:
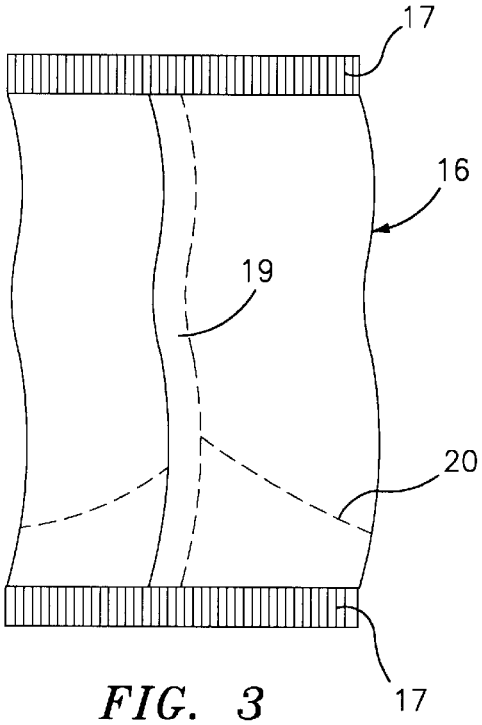
Figure 4:
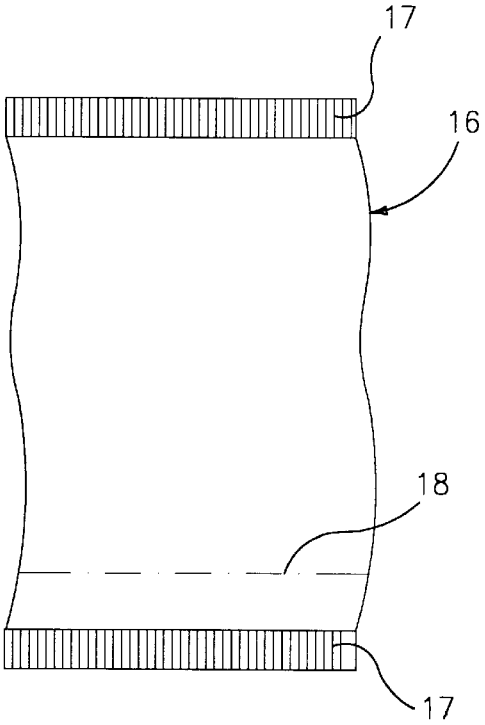

FIGS. 3 and 4 show a further tube-shaped pouch 16 with transverse seams 17 at both ends and a longitudinal seam 19. In FIG. 4 the weakness 18, situated below the printed image created by printing-inks, is indicated by a broken line. If the package is subjected to tensile force for example by holding the package at the transverse seams 17 and pulling, then the package separates along the line of weakness 18 and by pulling and for example simultaneously snapping backwards, the film material tears further, usually along a line 20 which is indicated by broken lines in FIG. 3. The line 20 terminates at the longitudinal seam 19 as there is an accumulation or thickening of material due to folding and sealing. As a result, the pouch 16 is open around its periphery up to the region of the longitudinal seam 19 and the contents can be easily removed for example by pushing it out from one end. Both parts of the tube-shaped pouch 16 are held together by the longitudinal seam 19 and can then be disposed of together.

Figure 5:
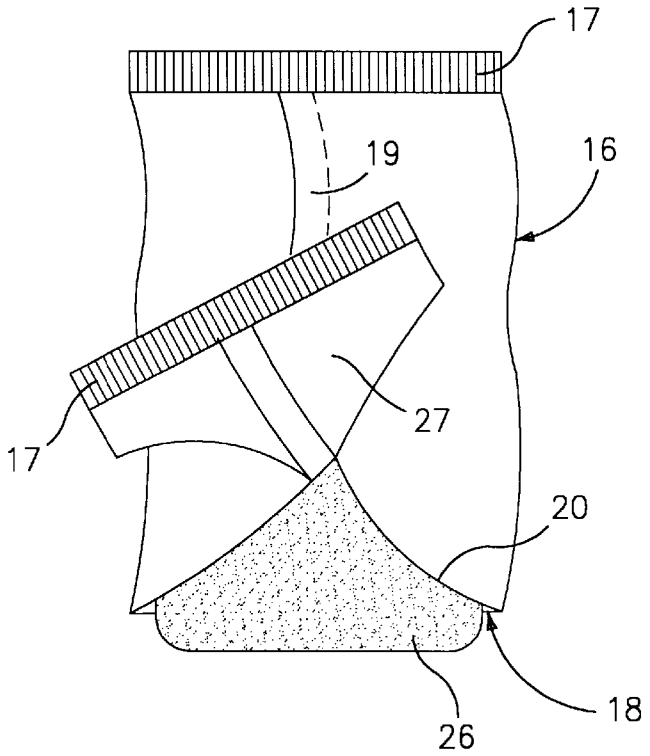

FIG. 5 shows the tube-shaped pouch 16 with transverse seams 17 and longitudinal seam 19 in the opened state. The part 27 of the pouch 16 which has been snapped back is joined to the rest of the pouch 16 by means of the packaging material at the longitudinal seam 19. The tearing action took place along the line of weakness 18 and continued along line 20 up to the longitudinal seam 19. The contents 26, for example a bar of chocolate can now be removed easily from the package or eaten directly from the package.

Figure 6:
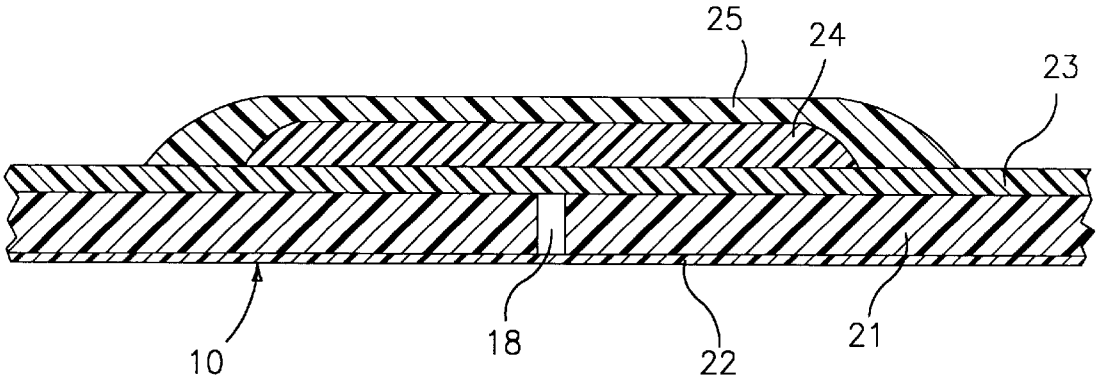

FIG. 6 shows a section through the packaging material 10 in the region of the weakness 18. The weakness 18 was made for example in a plastic film 21 and takes the form of a separation of the plastic film. The plastic film 21 on the outward facing side of the pouch bears a multi-layered, as a rule multi-colored—printed image having layers 23, 24 and 25. On creating the image an additional layer of printing-ink 24 (as a film forming mass) was deposited in the region of the weakness 18; as a result, the overall thickness of the printing-ink is increased over that in the rest of the packaging material 10, the weakness definitely covered over, sealed and tensile strength again restored in the packaging material 10. If desired, the sealing layer 22, in particular a sealing lacquer or varnish may be deposited on the inward facing side of the packaging material. The organic sealing layer 22 is employed mainly for sealing the seams; its properties can, however, reinforce the action of the organic printing material 23, 24, 25. The pouches coated with film-forming masses are preferably tube-shaped pouches.

I claim:

1. A pouch for holding contents, which comprises at least one flexible packaging material having a surface with an outside and inside thereof and including a zone for tearing the pouch open, wherein the zone for tearing the pouch open is a region of weakness in the packaging material and the region exhibiting the weakness is covered over on said surface to an area of at least 2 to 20 mm neighboring said region of weakness with at least one film-forming mass in the form of a coating printed onto the packaging material selected from the group consisting of (1) a multilayered, multicolored coating and (2) a coating including printing ink, which provides the packaging material with tensile strength in the area of weakness and wherein the contents of the pouch are protected by the pouch and, to remove the contents from the pouch, a pulling or snapping movement breaks the packaging material and the film-forming mass at the region of weakness, whereupon the contents of the pouch become accessible.

2. A pouch according to claim 1, wherein said film-forming mass in the region of weakness is thicker than in the rest of the pouch.

3. A pouch according to claim 1, wherein said film-forming mass at least in the region of weakness is deposited in amount ranging from 2 to 8 $gm/m^2$.

4. A pouch according to claim 3, wherein said amounts range from 3 to 6 $gm/m^2$.

5. A pouch according to claim 3, wherein said amounts range from 3.5 to 5 $gm/m^2$.

6. A pouch according to claim 1, wherein said pouch has a periphery and the weakness is in the form of one of a perforation and separation and the weakness extends over the whole of the periphery.

7. A pouch according to claim 1, wherein said pouch has a periphery and the weakness is in the form of one of a perforation and separation and the weakness extends over a part of the periphery of the pouch.

8. A pouch according to claim 1, wherein the pouch has an edge region and the weakness is situated over the contents of the pouch in an edge region thereof.

9. A pouch according to claim 1, wherein said coating is printed on the outside surface.

10. A pouch according to claim 1, including at least one sealing layer over the packaging material.

11. A pouch according to claim 10, wherein said sealing layer is on the inside surface.

12. A pouch according to claim 1, wherein the pouch exhibits transverse end seals.

13. A pouch according to claim 12, wherein the pouch also exhibits a longitudinal seal.

14. A pouch according to claim 13, wherein said region of weakness is transverse to the longitudinal seal and located from 10 to 30 mm from the end of the pouch.

15. A pouch according to claim 13, wherein breaking the packaging material and the film-forming mass provides a torn portion of the pouch which remains attached to the pouch at the longitudinal seal.

16. A pouch according to claim 1, wherein the pouch is a tube-shaped pouch.

17. A pouch according to claim 1, wherein said pouch is completely covered with said film-forming mass.

18. A pouch according to claim 1, wherein said film-forming mass includes a plurality of layers.

* * * * *